US006485553B1

(12) United States Patent
Guinn

(10) Patent No.: US 6,485,553 B1
(45) Date of Patent: Nov. 26, 2002

(54) FILLER MATERIAL AND WAX COMPOSITION FOR USE IN INVESTMENT CASTING

(75) Inventor: Paul A. Guinn, Brecksville, OH (US)

(73) Assignee: The Kindt-Collins Company, Brecksville, OH (US)

( * ) Notice: Subject to any disclaimer, the term of this patent is extended or adjusted under 35 U.S.C. 154(b) by 93 days.

(21) Appl. No.: 09/642,411

(22) Filed: Aug. 21, 2000

(51) Int. Cl.[7] ..... C08L 91/06; B22L 7/02; B22C 9/04

(52) U.S. Cl. ..... 106/38.8; 106/272; 164/35; 164/521

(58) Field of Search ..... 106/272, 38.8; 164/35, 521

(56) References Cited

U.S. PATENT DOCUMENTS

| | | | | |
|---|---|---|---|---|
| 3,129,465 | A | | 4/1964 | Poyner |
| 3,264,128 | A | | 8/1966 | Argueso, Jr. et al. |
| 3,323,173 | A | | 6/1967 | Poyner |
| 3,394,095 | A | | 7/1968 | Treacy |
| 3,465,808 | A | | 9/1969 | Uram |
| 3,498,813 | A | | 3/1970 | Treacy |
| 3,944,695 | A | | 3/1976 | Kosaka et al. |
| 4,144,075 | A | | 3/1979 | Koenig |
| 4,235,761 | A | | 11/1980 | Koenig |
| 4,280,939 | A | | 7/1981 | Johnson |
| 4,404,299 | A | | 9/1983 | Decroix |
| 4,990,013 | A | * | 2/1991 | Hejmanowski ..... 106/272 |
| 5,006,583 | A | | 4/1991 | Argueso |
| 5,036,129 | A | | 7/1991 | Atwell et al. |
| 5,041,482 | A | | 8/1991 | Ornsteen et al. |
| 5,139,373 | A | | 8/1992 | Logan et al. |
| 5,210,695 | A | | 5/1993 | Wood |
| 5,269,102 | A | | 12/1993 | Wood |
| 5,270,360 | A | | 12/1993 | Solomon |
| 5,326,413 | A | | 7/1994 | Esemplare et al. |
| 5,341,604 | A | | 8/1994 | Wood |
| 5,349,787 | A | | 9/1994 | Wood |
| 5,372,768 | A | | 12/1994 | Solomon |
| 5,505,654 | A | | 4/1996 | Wood et al. |

FOREIGN PATENT DOCUMENTS

| | | |
|---|---|---|
| EP | 0 524 333 A1 | 7/1991 |
| GB | 2 075 031 A | 11/1981 |
| GB | 2 096 525 A | 10/1982 |

* cited by examiner

*Primary Examiner*—David Brunsman
(74) *Attorney, Agent, or Firm*—Watts, Hoffmann, Fisher & Heinke, Co., LPA

(57) ABSTRACT

A wax composition for use in investment casting having improved properties includes polyethylene terephthalate as a filler material. The amount of polyethylene terephthalate used in the wax composition ranges from about 5 to about 50 parts by weight of the total wax composition. The use of polyethylene terephthalate as the filler material is effective for controlling the expansion and contraction properties of the wax composition providing a high degree of dimensional accuracy. Polyethylene terephthalate is relatively inexpensive compared to other inert filler materials, does not react with the mold, allows the wax pattern to be readily removed from the mold with reduced tendencies for shell cracking and results in little or no appreciable ash residue upon firing.

19 Claims, No Drawings

FILLER MATERIAL AND WAX COMPOSITION FOR USE IN INVESTMENT CASTING

FIELD OF THE INVENTION

The present invention relates to wax compositions for use in investment casting. More specifically, the invention is directed to the use of polyethylene terephthalate as a filler material for the wax compositions used in investment casting.

BACKGROUND OF THE INVENTION

The lost wax process, also known as the cire perdue process, has been used as a process for investment casting for centuries. In the lost wax process, a refractory mold is built up around a pattern of wax and then heated so as to melt and drain off the wax. The resulting mold is then used to cast the desired object.

Generally, the lost wax process involves injecting a wax into a die having an area defining an object to be manufactured, such as a golf club head or a piece of jewelry. A wax duplicate of the object is then removed from the die. The next steps are directed to preparing a refractory shell of the wax object. These steps typically include dipping the wax object into a ceramic slurry so as to build up a durable ceramic shell about the wax object. Once the shell reaches a desired thickness, the wax is removed from the shell. Wax can be removed from the mold by any one of several means of heating. Of these, only the steam autoclave uses a defined pressure whereas flash fire dewaxing is done in high temperature furnaces with no pressure. Hot wax dewaxing, which is rarely used, is also without pressure. After dewaxing, the molds are fired at high temperatures to cure the ceramic and burn out any wax residues before pouring the metal. All traces of the wax composition are preferably removed from the ceramic mold so as to prevent defects in the final product. Next, a desired alloy is melted and brought to the required pouring temperature. In the interim, the ceramic mold is generally heated so as to prevent thermal shock as the molten metal is poured into the mold. Once poured, the mold is allowed to cool and the metal alloy set. The ceramic mold is then removed from the cast object. The raw casting is then further finished, i.e., patination, deburring, removal of gates and sprues used during the investing steps, etc.

One problem with investment casting occurs when the wax composition is injected into the die. Generally, the wax composition is injected at an elevated temperature so that the wax will flow and fill all the interstices of the object to be manufactured. Waxes injected under pressure are subject to shear causing them to become somewhat more fluid. As such, it is not necessary to heat waxes until they are completely liquid in order to completely fill the interstices of a ceramic mold. However, when the wax composition is injected into a complicated mold pattern having different section thicknesses, the different section thicknesses cool at different rates. As would be expected, the thinner areas cool relatively quickly, whereas the thicker sections cool considerably slower. As a result, it has been found that the thinner areas reproduce that particular section with a high degree of dimensional accuracy. In contrast, the wax in the thicker sections tends to shrink during cooling causing dimensional inaccuracies since the object to be manufactured is an exact duplicate of the wax pattern. Moreover, because of the different rates of cooling and shrinkage between the thin and thick sections, considerable stresses can be imposed on the wax pattern, and when removed from the die, the pattern may distort in order to relieve the strain.

One solution to increase dimensional accuracy and stability of the wax composition has been attempted by the addition of various filler materials in the waxes such as organic acids and inert polymeric materials. The term "filler material" is hereinafter defined as discrete solid particles that do not melt during the investment casting process. The use of filler materials has improved some features of the process but has also introduced new problems as well as leaving other problems unsolved.

Among the various materials that have been suggested as useful fillers for investment casting wax compositions but which have not met all of the desirable physical properties for pattern making or have resulted in new problems include fillers such as polystyrene as disclosed in U.S. Pat. No. 3,465,808. Wax compositions containing polystyrene fillers have a propensity for the wax to melt out first during dewaxing leaving a polystyrene residue in the mold that tends to tear the ceramic mold.

Organic acids, such as fumaric acid, adipic acid, terephthalic acid and isophthalic acid, have also been used as a filler material. In general, the organic acid filler materials have a high thermal conductivity. That is, this type of filler material allows the wax compositions to desirably cool quickly even in the thicker sections. However, the major drawbacks with the use of acid fillers in wax compositions is the possibility that these acidic fillers will react with the refractory mold material and consequently, affect the surface finish and dimensional accuracy of the cast part or expand too rapidly during dewaxing and cause shell cracking in the mold.

Inert polymeric filler materials do not chemically react with the refractory mold materials. However, the thermal conductivity of these materials is generally poor compared with the organic acid type fillers. That is, cooling is non-uniform for the varying section thicknesses and as such, shrinkage still remains a serious problem with respect to dimensional accuracy. In addition to poor thermal conductivity, these polymeric materials are generally more difficult to remove from the mold during the wax removal steps. As a result, significant amounts of ash residue may form in the mold during the firing steps and these residues will undesirably become imprinted onto the casted object. The most commonly used inert polymeric filler materials are polystyrene and acrylic type polymers.

Prior art fillers suffer additional drawbacks. For example, urea tends to decompose when the wax is melted and organic acids have high specific gravities and thus tend to settle quickly when not sufficiently agitated. Moreover, many fillers have a relatively high thermal conductivity which can lead to premature expansion of the investment casting wax composition upon autoclaving and thereby cause shell cracking. Additionally, many fillers can produce environmentally hazardous or carcinogenic materials upon combustion.

SUMMARY OF THE INVENTION

The present invention is directed to a new filler material and its use in wax compositions for investment casting. In particular, it has been found that polyethylene terephthalate is preferred for use as a filler material in wax compositions. The material is safe to handle and is capable of convenient melting or burning out of the mold. Also known as PET, polyethylene terephthalate advantageously does not chemically react with the refractory mold materials used in investment casting. Unexpectedly, the use of polyethylene terephthalate as a filler material results in wax compositions having very desirable thermal properties which allow high pattern production rates without the shell cracking problems typically associated with organic acid fillers. Moreover, unlike other inert polymeric materials, it has been found that the polyethylene terephthalate wax compositions readily flow from the mold during the wax removal steps which consequently results in little or no appreciable ash residue in the mold upon firing. As such, the use of wax compositions using polyethylene terephthalate as a filler material is especially useful in investment casting of parts that require a high degree of dimensional accuracy. Moreover, the higher specific gravity of polyethylene terephthalate allows the filler to be easily separated from the base wax to allow the base wax to be reclaimed and reused.

In general, the wax composition comprises:

a. polyethylene terephthalate in an amount ranging from about 5 to about 50 parts by weight based upon the total weight of the composition; and b. wax in an amount ranging from about 50 to about 95 parts by weight based upon the total weight of the composition.

The sum of the weights of the composition preferably totals 100 parts by weight. Of course, other compounds (such as preservative) may be added or omitted from a calculated formulation that has amounts of compounds that total 100 parts by weight, in which case the relative amounts of each of the compounds would be adjusted accordingly to total 100 parts by weight, as would be apparent to one skilled in the art in view of this disclosure.

The wax composition may also contain chemical additives such as other polymers, resins and fillers depending on the properties desired. In the event that other filler materials are added to the wax composition, it is preferred that polyethylene terephthalate is present in an amount ranging from about 5 parts by weight to about 50 parts by weight of the total wax composition. Filler materials suitable for admixing with polyethylene terephthalate and wax include organic acids, polystyrenes, polystyrenes cross-linked with divinylbenzene, urea, polyacrylates, cellulose acetates, bisphenols and other high melting point polyols.

A method for investment casting includes injecting into a mold a wax composition to form a solid pattern and investing the pattern to form a cast. Polyethylene terephthalate is ground wherein at least 90% of the particles have a diameter less than 150 microns and at least about 50% of the particles are not greater than 75 microns and then suspended in wax to form the wax composition. The polyethylene terephthalate has a specific gravity from about 1.31 to about 1.45 grams per milliliter and is present in an amount ranging from about 5 parts to about 50 parts by weight of the wax composition.

Many additional features, advantages and a fuller understanding of the invention will be had from the detailed description that follows.

DETAILED DESCRIPTION OF PREFERRED EMBODIMENTS

The present invention is directed to wax compositions used in investment casting. In particular, the wax compositions of the present invention comprise polyethylene terephthalate as a filler material and wax. Its use as the filler material in wax compositions offers significant improvements and overcomes many of the prior art disadvantages. Polyethylene terephthalate is substantially non-reactive and chemically inert material. The polyethylene terephthalate filler materials have a high thermal conductivity that advantageously allows the wax compositions to cool quickly. As a result, the use of polyethylene terephthalate wax compositions in investment casting allows for fast cycle times. Moreover, during the wax removal process steps, the polyethylene terephthalate wax composition is readily and easily removed from the mold. As a result, little or no ash residue is formed in the mold during the subsequent firing steps resulting in castings that are highly accurate and have smooth finishes. It has been further discovered that the polyethylene terephthalate wax compositions are readily recyclable allowing the wax to be easily separated from the filler, then filtered and used repeatedly to produce significant cost savings to the investment casting process.

The wax composition of the present invention comprises polyethylene terephthalate as a filler material in an amount ranging from about 5 to about 50 parts by weight and more preferably ranging from about 25 to about 40 parts by weight. The wax ranges in an amount from about 50 to about 95 parts by weight, and more preferably from about 60 to about 75 parts by weight.

The sum of the weights of the composition preferably totals 100 parts by weight. Of course, other compounds may be added or omitted from a calculated formulation that has amounts of compounds that total 100 parts by weight, in which case the relative amounts of each of the compounds would be adjusted accordingly to total 100 parts by weight, as would be apparent to one skilled in the art in view of this disclosure.

Polyethylene terephthalate is manufactured by conventional polymerization techniques and is widely available commercially in many different forms. Conventionally, polyethylene terephthalate is produced by reacting ethylene glycol with terephthalic acid or dimethyl terephthalate. It is commercially available as sheets, rods, granules, pellets or the like. Polyethylene terephthalate is a hard, stiff, dimensionally stable material with a relatively high specific gravity from about 1.31 to about 1.45 gm/ml. The higher specific gravity allows the filler to be easily separated from the base wax to allow the base wax to be reclaimed and reused. By dimensionally stable, it is meant that polyethylene terephthalate does not melt or decompose during its use in the investment casting process.

The melting temperature of polyethylene terephthalate is greater than 400° F., well above the temperatures typically used for the wax injection and removal steps. Its decomposition temperature is greater than about 700° F., which is significantly lower than the temperatures used during the firing steps. Consequently, the use of polyethylene terephthalate in wax compositions leaves little or no appreciable residual ash content during investment casting.

Examples of suitable commercial polyethylene terephthalate include those sold under the part number Eastman 7169, manufactured by Eastman Chemical Company. It is preferred that the polyethylene terephthalate material is ground into small particles for use as a filler material. The preferred particle size used in the wax composition will depend on the pattern to be cast. Ideally, the particles should be small enough so as to remain evenly distributed throughout the thinnest sections of the casted pattern. Preferably, the polyethylene terephthalate is ground to a fine powder wherein at least 90% of the particles obtained have a diameter less than 150 microns and more preferably at least 50% of the particles are at least 75 microns or smaller.

The wax composition of the present invention contains polyethylene terephthalate in any suitable wax base composition. Suitable wax compositions can include petroleum waxes, natural vegetable or mineral waxes, synthetic waxes and polymers, and various resinous materials derived from the refining of petroleum and wood resins, lower alkyl hydrocarbon resins, terpene-type resins or mixtures of these materials or the like. The base wax compositions usually melt at temperatures well below the softening point of polyethylene terephthalate in the range of about 110° F. to about 240° F. These base waxes are well known in the art and it is well within the skill of those in the art to readily determine the suitability of any base wax for use in investment casting. For example, some casting applications require the wax composition to have a certain degree of hardness so as to form acceptable patterns with minimal shrinkage. Polyethylene terephthalate is a hard material by itself and the base wax composition must also have a certain degree of hardness for use in investment casting. Typically, the wax is melted and the polyethylene terephthalate is mixed and suspended in the wax.

A suitable base wax consists essentially of 0 to 15% vegetable wax, 20 to 60% of petroleum wax consisting of mixtures of paraffin waxes having a melting point from 120 to 160° F., and microcrystalline waxes having a melting point of from 135 to 205° F., 1 to 15% of synthetic waxes such as Fisher-Tropsch waxes, polyethylene, ethylene vinyl acetate, or amides, and about 15–70% of various resins, such as hydrocarbon resins or resins derived from the refining of petroleum or of wood products, particularly those known as polyterpene resins. The preferred vegetable waxes are candelilla and carnauba waxes. These waxes are well known in the art and, therefore, need not be discussed further.

The final form of the wax composition containing the polyethylene terephthalate filler material can be in flake, slab, or billet form or other suitable forms generally known to those skilled in the art. Such compositions exhibit no appreciable residual ash content after firing, generally below about 0.02% by weight. The wax composition may also contain chemical additives such as other polymers, resins and fillers. In the event that other filler materials are added to the wax composition, it is preferred that polyethylene terephthalate is present in an amount greater than about 5% by weight of the total wax composition. More preferably, the amount of polyethylene terephthalate is present in an amount by weight greater than the amount by weight of the additional filler. Filler materials suitable for admixing with polyethylene terephthalate and wax include organic acids, polystyrenes, polystyrenes cross-linked with divinylbenzene or urea, polyacrylates, cellulose acetates, bisphenols and high melting polyols. Examples of organic acid fillers include fumaric acid, adipic acid, terephthalic acid and isophthalic acid. Other filler materials suitable for admixing will be apparent to one skilled in the art in view of this disclosure. Other chemical additives for use in the present invention will be apparent to one skilled in the art in view of this disclosure.

The wax compositions are suitable for use in either the solid mold investment casting process or the shell investment casting process. First, the wax composition is injected into a suitable die for making a wax pattern. The wax pattern is an identical copy of the part to be cast later on in either process. Wax patterns are fastened to a wax sprue or runner usually forming a cluster and the runners are attached to a pouring cup. In the solid mold investment casting process, the sprued pattern is invested in a mold slurry which is allowed to harden. In the shell investment casting process, the sprued pattern is dipped in a ceramic slurry and a refractory grain is then sifted onto the coating. The process is repeated until a desired thickness is achieved.

In either process, the wax pattern formed by the polyethylene terephthalate wax composition is then removed from the ceramic mold by melting in a steam autoclave or other suitable means. Advantageously, it has been found that polyethylene terephthalate wax composition does not tend to adhere to the interior surfaces during the wax removal steps. The wax compositions readily flow from the mold leaving little or no residue during the subsequent firing steps. The temperatures used during the dewaxing process are well below the softening point of polyethylene terephthalate, typically at temperatures less than about 350° F. The removed wax can be recycled for subsequent use. As previously described, the ceramic mold is then fired at higher temperatures, typically at temperatures greater than about 1000° F., to remove any residue of the wax composition and to cure the ceramic mold. It is important to note that polyethylene terephthalate is stable at the dewaxing temperatures and readily decomposes during firing leaving little or no ash residue. Moreover, polyethylene terephthalate produces essentially no carcinogenic material upon complete combustion. The necessary alloy is melted and brought to its required pouring temperature. In the meantime, the mold is heated to minimize thermal shock upon pouring the molten metal into the mold. The mold is then filled with molten metal and allowed to harden. After the mold has cooled, it is then broken and removed to yield the cast part. The cast part is then suitably finished in a manner generally known to those skilled in the art.

The following examples are detailed description of methods of preparation and use of the composition of the present invention. The detailed preparations fall within the scope of, and serve to exemplify, the more generally described methods set forth above. The examples are presented for illustrative purposes only, and are not intended to limit the scope of the invention.

EXAMPLE 1

Composition containing polyethylene terephthalate in a wax mixture is as follows.

| COMPONENTS | Parts by Weight |
|---|---|
| Paraffin wax, mp 140° F. (ASTM D-87) | 14 |
| Microcrystalline wax, mp 155° F. (ASTM D-127) | 7 |
| Candelilla Wax | 4 |
| Aliphatic C5 Hydrocarbon Resin, mp 115° C. (ASTM E-28) | 10 |
| Polyterpene Resin, mp 115° C. (ASTM E-28) | 23 |
| Polyethylene resin, Mettler Drop Point 102° C. | 2 |
| Polyethylene terephthalate | 40 |

The polyethylene terephthalate is ground to a fine powder wherein at least 90% of the particles obtained have a diameter less than 150 microns and preferably at least 50% of the particles are at least 75 microns or smaller. The waxes are melted and the polyethylene terephthalate is mixed and suspended in the wax.

EXAMPLE 2

In this example, the wax-filler composition of example 1 is injected into a wax pattern at 145° F., and 250 psi. A refractory mold is built up around the wax pattern to a suitable thickness and then heated so as to melt and drain off the wax. The mold is then fired to cure the mold and burn off any residue remaining in the mold. The disposable pattern has no appreciable residual ash and produces a casting with a highly accurate and smooth surface finish. Moreover, in those areas that varied in section thickness, the dimensional accuracy of the original object was reproduced indicating that shrinkage was minimal and little or no ash residue was present.

Many modifications and variations of the invention will be apparent to those skilled in the art in light of the foregoing disclosure. Therefore, it is to be understood that, within the scope of the appended claims, the invention can be practiced otherwise than has been specifically shown and described.

What is claimed is:

1. In an investment casting wax composition for use in an investment casting process, the improvement wherein particles of polyethylene terephthalate are present in the wax composition as a filler material, wherein at least about 50% of said polyethylene terephthalate particles have a diameter not greater than 150 microns.

2. The investment casting wax composition according to claim 1 wherein said polyethylene terephthalate is present in an amount ranging from about 5 to about 50 parts by weight of the total wax composition.

3. The investment casting wax composition according to claim 1 wherein said polyethylene terephthalate has a specific gravity from about 1.31 to about 1.45 grams per milliliter.

4. The investment casting wax composition according to claim 1 wherein at least 90% of the particles have a diameter less than 150 microns and at least about 50% of the particles are not greater than 75 microns.

5. The investment casting wax composition according to claim 1 wherein said polyethylene terephthalate is present in an amount ranging from about 25 to about 40 parts by weight of the total wax composition.

6. The investment casting wax composition according to claim 1 further comprising an additional filler material selected from the group consisting of an organic acid filler, a polystyrene filler, an acrylic filler, a bisphenol filler and mixtures thereof.

7. The investment casting wax composition according to claim 6 wherein said organic acid filler is selected from the group consisting of fumaric acid, adipic acid, terephthalic acid, isophthalic acid and mixtures thereof.

8. A wax composition for use in investment casting comprising polyethylene terephthalate wherein at least about 50% of said polyethylene terephthalate particles have a diameter not greater than 150 microns and are present in an amount ranging from about 5 to about 50 parts by weight of the total wax composition and waxes in an amount ranging from about 50 to about 95 parts by weight of the total wax composition.

9. The wax composition of claim 8 wherein said polyethylene terephthalate is in an amount ranging from about 25 to about 40 parts by weight of the wax composition.

10. The wax composition of claim 8 wherein said waxes are selected from a group consisting of a vegetable wax, mineral wax, resinous materials derived from the refining of petroleum and wood resins, terpene-type resins, a petroleum wax, lower alkyl hydrocarbons, a microcrystalline wax, a synthetic wax and polymers, and mixtures thereof.

11. The wax composition of claim 10 wherein said vegetable wax is selected from the group consisting of a carnauba wax and a candelilla wax.

12. The wax composition of claim 8 further comprising an organic acid filler selected from the group consisting of a fumaric acid, an adipic acid, a terephthalic acid, an isophthalic acid and mixtures thereof, wherein said polyethylene terephthalate is present in an amount ranging from about 5 to about 50 parts by weight of the total wax composition.

13. The wax composition of claim 8 further comprising a filler material selected from the group consisting of a polystyrene, a polystyrene cross-linked with divinylbenzene, a urea, a polyacrylate, a cellulose acetate and a bisphenol, wherein said polyethylene terephthalate is present in an amount ranging from about 5 to about 50 parts by weight of the total wax composition.

14. In a method of investment casting comprising forming in a die a wax pattern comprising a wax composition and then investing said wax pattern to form a cast, the improvement comprising suspending a filler material in the wax composition wherein said filler material comprises polyethylene terephthalate.

15. The method of investment casting according to claim 14 wherein said polyethylene terephthalate has a specific gravity from about 1.31 to about 1.45 grams per milliliter.

16. The method of claim 14 wherein said polyethylene terephthalate is present in an amount ranging from about 5 parts to about 50 parts by weight of the wax composition.

17. The method of claim 14 further comprising grinding said polyethylene terephthalate before suspending the filler material in the wax composition wherein at least 90% of the particles have a diameter less than 150 microns and at least about 50% of the particles are not greater than 75 microns.

18. A method for investment casting comprising:

injecting into a mold a wax composition to form a solid pattern, said wax composition comprising polyethylene terephthalate in an amount ranging from about 5 to about 50 parts by weight and wax in an amount ranging from about 50 to about 95 parts by weight of the total wax composition; and investing said pattern to form a cast.

19. In an investment casting wax composition for use in an investment casting process, the improvement wherein particles of polyethylene terephthalate are present in the wax composition as a filler material in an amount ranging from greater than 10 to about 50 parts by weight of the total wax composition.

* * * * *